United States Patent [19]

Snyderman et al.

[11] Patent Number: 5,069,447

[45] Date of Patent: Dec. 3, 1991

[54] ADJUSTABLE WEIGHT-LIFTING BENCH

[75] Inventors: Fredric Snyderman, Sharon; Robert H. Russell, Norwood, both of Mass.

[73] Assignee: CSA, Inc., South Easton, Mass.

[21] Appl. No.: 618,161

[22] Filed: Nov. 26, 1990

[51] Int. Cl.[5] ..... A63B 21/00

[52] U.S. Cl. ..... 272/123; 272/134; 272/144

[58] Field of Search ..... 269/322-326; 128/73, 74; 5/66, 67, 68, 69, 62; 272/144, 123, 145, 134, 117, 118, DIG. 4

[56] References Cited

U.S. PATENT DOCUMENTS 3,003,160 10/1961 Goodman ..... 5/66

4,634,127 1/1987 Rockwell ..... 272/134

4,861,025 8/1989 Rockwell ..... 272/144

*Primary Examiner*—Stephen R. Crow

*Assistant Examiner*—Jerome Donnelly

*Attorney, Agent, or Firm*—Herbert L. Bello

[57] ABSTRACT

An adjustable weight-lifting bench is disclosed adapted such that it can be converted from a flat to a sitting position with little or no displacement of the user's head and shoulders in relation to the stationary upright barbell supports. The bench seat frame is pivotally connected to the back frame, a second end of the seat frame is pivotally connected to one end of a support arm, and the second end of the support arm is pivotally connected to a base frame, together with means for releasably connecting the support arm to the back frame at different locations along the length of the support arm.

22 Claims, 2 Drawing Sheets

ADJUSTABLE WEIGHT-LIFTING BENCH

BACKGROUND OF THE INVENTION

1. Field of Invention

The present invention relates to exercise devices and, more particularly, to exercise benches.

2. Description of the Prior Art

It is well-known in the art of weight lifting that certain conventional weight-lifting exercises require a substantially flat support bench that lies in a plane which is substantially parallel to the floor (e.g. the flat bench press, flat dumbbell butterfly, and leg curls). Other common weight-lifting exercises, on the other hand, require a V-shaped support bench in a sitting position wherein the back support and seat portions lie in planes that are at an acute angle of about 45° to the floor and at approximately a 90° angle with respect to each other (e.g. the incline bench press, incline dumbbell butterfly, and extension leg lift).

It is also well-known in the art to provide an adjustable weight-lifting support bench comprising a split bench having a back support section and a seat section connected in hinged relationship so that the bench can be adjusted for use in connection with both flat bench and sitting position exercises.

One major disadvantage of the prior art adjustable weight-lifting benches relates to the shift in orientation of the user's head with respect to the upright barbell supports when the benches are moved from the flat position to the inclined position. In general, conventional weight-lifting benches are so constructed that, when the bench is in the flat position, the user's head and shoulders are directly under the barbell set. This orientation helps to insure a safe and proper lifting position.

But, when the conventional weight-lifting bench is converted to its inclined position by moving the hinged section vertically downward, the result is to move the back support section toward the seat section and, at the same time, away from the stationary upright barbell supports This movement of the back support section in turn results in shifting the user's body position toward the seat end of the bench such that the user's head and shoulders are no longer are directly under the barbell set, but rather are forward of the barbell supports. Such a position is both awkward and potentially dangerous. These and other disadvantages of the prior art are overcome with the present invention.

SUMMARY OF THE INVENTION

It is an object of the present invention to provide an exercise bench that does not suffer from the disadvantages of prior art exercise benches.

It is another object of the present invention to provide an adjustable weight-lifting bench that results in little or no shifting of the user's head and shoulders with respect to the stationary upright barbell supports when the bench is converted from a flat position to a sitting position.

It is a further object of the present invention to provide an adjustable weight-lifting bench that can be readily converted from a flat to a sitting position or vice versa with a single pin adjustment.

It is yet another object of the present invention to provide an adjustable weight-lifting bench that can be converted from a flat to a sitting position with little or no displacement of the user's head and shoulders in relation to stationary upright barbell supports. The bench comprises a base, a back frame, a seat frame and a support arm. One end of the seat frame is pivotally connected to the back frame and a second end of the seat frame is pivotally connected to one end of the support arm. A second end of the support arm is pivotally connected to the base frame. Adjustment means are provided for releasably connecting the support arm to the back frame at different locations along the length of the support arm.

It is still a further object of the present invention to provide an adjustable, inflatable lumbar support in the back cushion of the weight-lifting bench.

Other objects of the present invention will in part be obvious and will in part appear hereinafter.

The invention accordingly comprises the apparatuses, processes and products, together with their parts, steps, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE INVENTION

Figures 1, 1A:
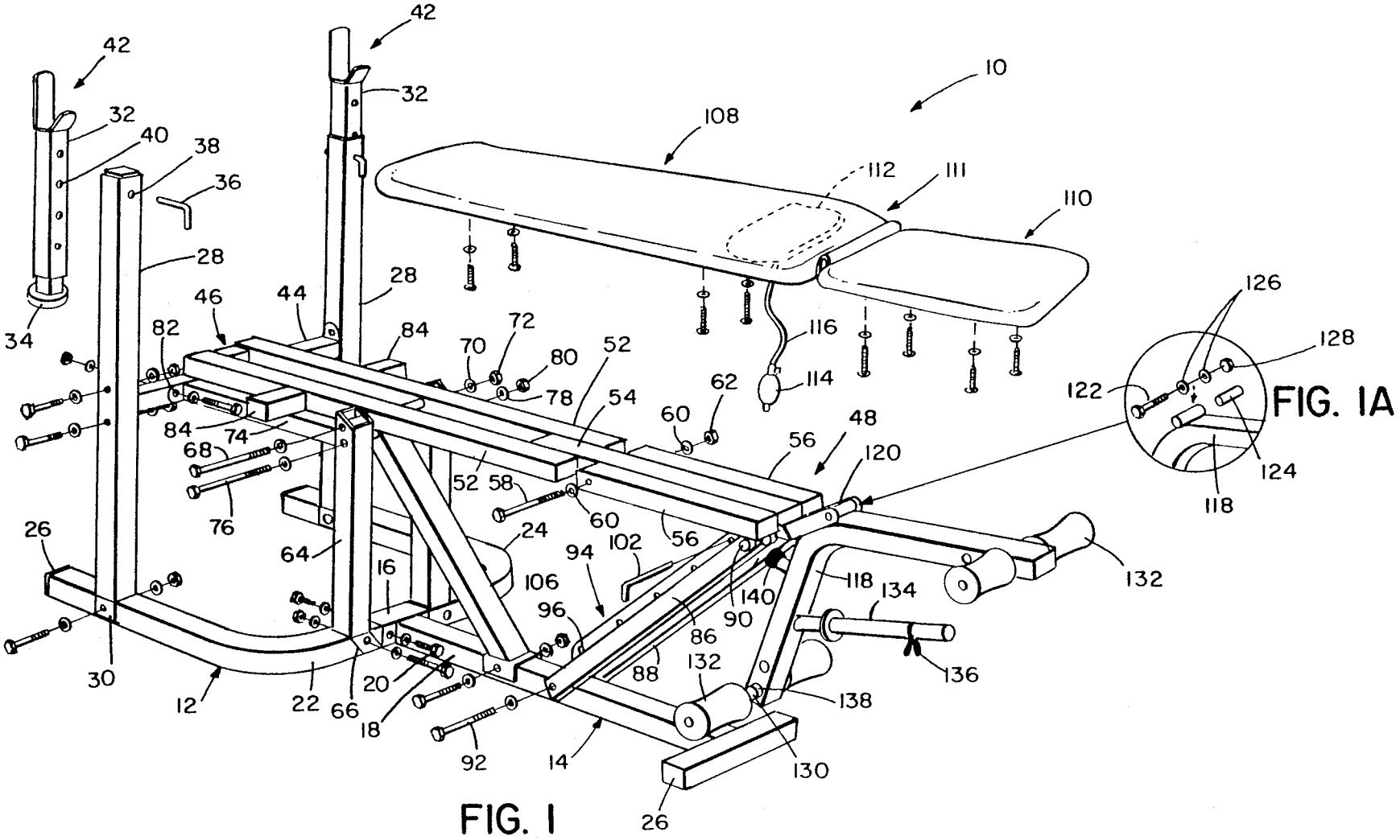
FIG. 1 is an isometric view of a partially assembled weight-lifting bench made in accordance with this invention.
FIG. 1A is an insert showing in enlarged detail one element of the invention.

Referring now to the drawings, particularly FIG. 1, there is shown a partially assembled weight-lifting bench 10 made in accordance with this invention showing a generally U-shaped head-end frame 12 and a generally T-shaped foot-end frame 14, both adapted to rest at least in part on a level surface. For additional structural support, head-end frame 12 and foot-end frame 14 are connected by fastening a coupler 16 at a stem 18 of the foot-end frame 14 at approximately the center point of the head-end frame by means of bolts 20, for example.

Frames 12 and 14, as well as other frame members as described below, are preferably flat-sided, hollow tubular members made of metal or metal alloy for strength, but they may also comprise solid members, wood or heavy-duty plastic members, and members with rounded sides or flat sides or a combination of flat and rounded sides. Instead of being fashioned as a single element, head-end frame 12 may advantageously comprise an L-shaped male 22 tubular element designed to mate with an L-shaped female tubular 24 element to form the U-shaped head end frame. The frame members may also be provided with end caps 26 to seal-off the hollow interiors of the frame members and to give the apparatus a more finished appearance.

A pair of upright barbell supports 28 extend upwardly from head-end frame 12, at points proximate to the extremities of the U-shaped frame and approximately equidistant from the center point of the U-shaped frame. Barbell supports 28 are securely fastened to frame 14, for example, using lock nuts that mate with bolts passing through frame 12 and through apertured extension feet 30 at the lower ends of barbell supports. The upper ends of barbell supports 28 are fitted with slidable extensions 32 having guides 34 at their lower ends. Upright lock pins 36 are designed to mate with apertures 38 and 40 that are formed in barbell supports 28 and extensions 32 are used to adjust the height of barbell rests 42 which extend from the upper ends of extensions 32. Preferably, a barbell cross-member 44 may be provided for additional support for the barbell supports 28. Barbell cross member 32 is connected to supports **28*b* by means of bolts, washers and lock nuts, for example. Cross-member 44 is located a distance above head-end frame 12 so as to also provide additional support for a back frame 46** as described below.

The weight-lifting bench 10 further comprises back frame 46 and a seat frame 48 that are pivotally connected to one another. As shown in FIG. 1, back frame 46 includes two side tubular members 52 and an extending center tubular member 54. Member 54 is connected at one end to members 52, while the other end of the center member extends beyond the ends of the side members. In the illustrated embodiment, seat frame 48 includes two side tubular members 56 spaced apart a distance so as to accommodate the extending end of member 54 therebetween. The ends of members 56 are pivotally connected to the extending end of member 54 by means of a pivot bolt 58 passing through apertures in members 56 and 54 and mating with washers 60 and a nut 62.

A pair of back frame supports 64 extend upwardly from U-shaped head-end frame 12 at points on either side of the center point of the head-end frame and are spaced from one another a distance approximately equal to the width of members 52 and member 54 of back frame 46. Back frame supports 64 are securely fastened to head-end frame 12, for example, using washers and lock nuts that mate with bolts passing through the head-end frame and through apertured extension feet 66 at the lower ends of supports 64. The upper ends of supports 64 are pivotally connected to members 52 respectively with pivot bolt 68 passing through apertures in supports 64 and in members 52 and mating with washers 70 and a nut 72. Back support cross members 74 may also be provided for additional support. Such back support cross members 74 are connected at one end thereof to the upper ends of supports 64 respectively with a bolt 76 passing through apertures in supports 64 and cross members 74 and mating with washers 78 and a nut 80. At their second ends, members 74 are attached to barbell cross member 44 by means of bolts mating with apertured brackets 82 at the second ends of members 74 and with apertures in the cross member. Support arms 84 extend outwardly from members 52 respectively in order to rest on cross members 74.

As discussed above, the first ends of members 56 are pivotally connected to the first end of member 54. The second ends of members 56 are pivotally connected respectively to first ends of support arms 86 and 88 with a pivot bolt 90. The second ends of support arms 86 and 88 are pivotally connected to either side of the stem element 18 of foot-end frame 14 with a pivot bolt 92. Integral with support arms 86 and 88 is an apertured fastening bar 94 located between arms 86 and 88 and projecting above the plane of the upper surfaces of arms 86 and 88.

Fastening bar 94 includes two or more apertures 96 in the projecting portion thereof, at least one aperture proximate the first ends of arms 86 and 88, and at least one aperture positioned intermediate the first and second ends of arms 86 and 88. The apertured portion of fastening bar 94 mates in sliding relationship with an elongated projection 98 (FIGS. 2 and 3) which extends from the underside of member 54 near the second end thereof. Elongated projection 98 has a closed, elongated slot 100. A lock pin 102 is dimensioned so as to pass through both the elongated slot of projection 98 and each of the several apertures 96 in the projecting portion of fastening bar 94 in order to readily releasably secure arms 86 and 88 in position relative to member 54.

Figure 2:
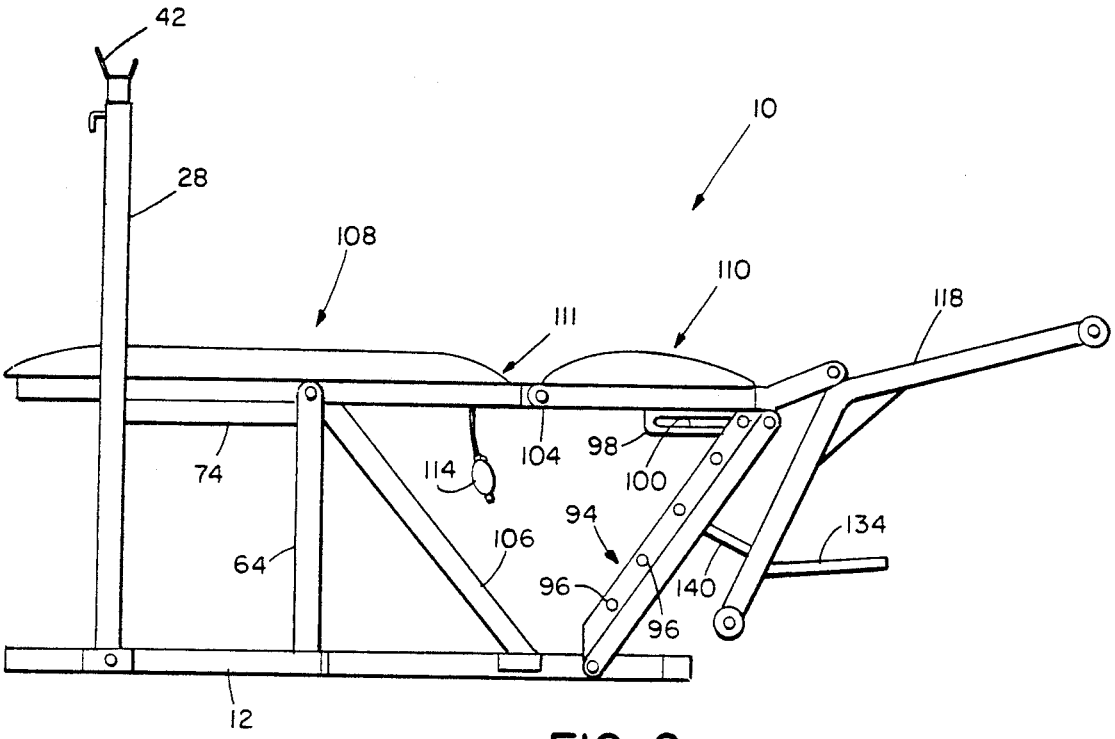
FIG. 2 is a side elevational view of one embodiment of the invention showing the weight-lifting bench in a flat position.

The operation of the apparatus of the present invention will now be explained by reference to the side elevational views of FIGS. 2 and 3. FIG. 2 illustrates weight-lifting bench 10 in its flat position. In the flat position of the weight bench 10, the aperture 96 of fastening bar 94 that is located nearest the upper end of the fastening bar is in alignment with a first end of the elongated slot 100 of projection 98. The weight bench 10 is maintained in this position using lock pin 102 (as illustrated in FIG. 1). It should be noted that, when the weight bench 10 is in this position, the user's head and shoulders can be positioned directly beneath barbell rests 42 for maximum convenience and safety.

Figure 3:
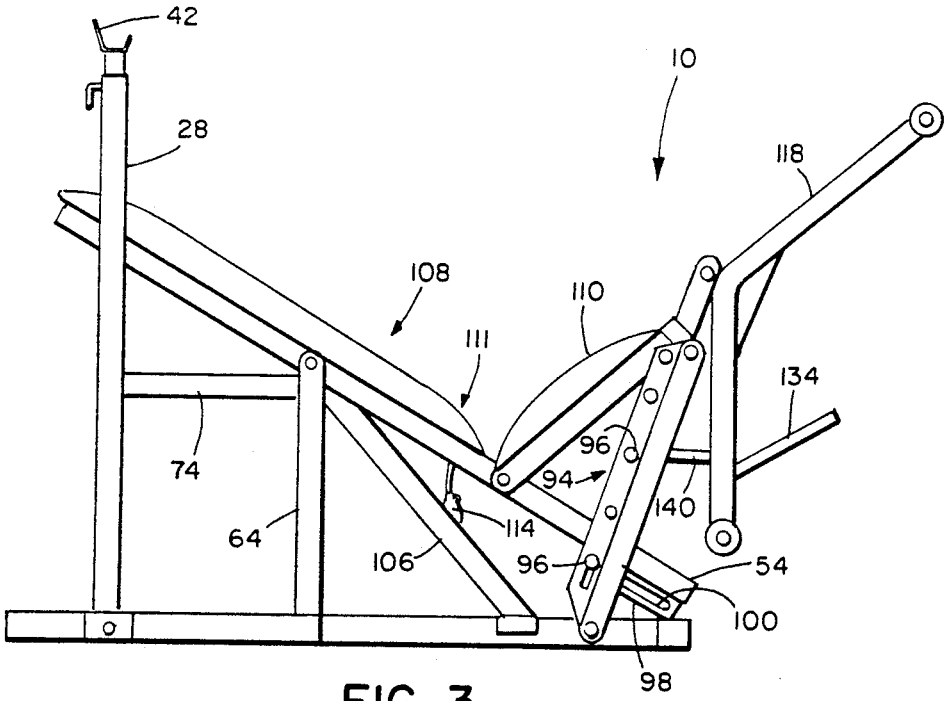
FIG. 3 is a side elevational view of one embodiment of the invention showing the weight-lifting bench in a sitting or inclined position.

FIG. 3 shows the weight bench 10 in its full sitting position. In order to adjust bench 10 from the flat position of FIG. 2 to the full sitting position of FIG. 3, lock pin 102 (FIG. 1) is withdrawn and arms 86 and 88 are moved so as to cause the lower-most aperture 96 of fastening bar 94 to be in alignment with the second end of the elongated slot 100 of projection 98. Lock pin 102 is then reinserted to maintain the weight bench 10 in its sitting position. Because of the manner in which the members of back frame 46 and seat frame 48 are pivotally connected to each other and to arms 86 and 88, the result of the aforementioned adjustment is to cause the back frame and seat frame to tilt so as to assume the full seating position shown in FIG. 3. By removing the lock pin 102 and reversing the above procedure, weight bench 10 can be readily returned to the flat position.

It should be noted that the adjustment of the weight bench 10 from the flat position to the full sitting position results in displacement of a pivot point 104 at which back frame 46 and seat frame 48 are joined. By comparing FIGS. 2 and 3, it is apparent that pivot point 104 moves both downwardly as well as somewhat laterally toward the head-end or barbell support end of weight bench 10. This movement is a key to the unique operation of weight bench 10. The small lateral displacement of pivot point 104 toward the barbell support end compensates, at least in part, for the tilting of back frame 46 when the bench is in the full sitting position. As a result of this movement, there is relatively little or no displacement of the user's head and shoulders relative to barbell rests 42 when weight bench is moved from the flat position to the sitting position.

With prior art adjustable weight benches, on the other hand, the adjustment from flat to sitting position involves only a downward displacement of the pivot point at which the back and seat frames are joined. Because the distance from the pivot point to the barbell supports as measured along the back support frame is now the hypotenuse of a 90° triangle (compare FIG. 3), whereas the user's body has a torso of fixed length, the result is that the user's head and shoulders are displaced away from the barbell support end when the prior art bench is in the sitting position.

Although the maximum benefits of this invention are realized by comparing the flat and full-sitting positions of the weight bench as described above, some weight-lifting exercises may require a partial sitting position. Intermediate sitting adjustments of this invention may be made by providing additional apertures 96 in fastening bar 94 as shown in FIGS. 1–3. In each of these intermediate sitting positions, there will be some lateral displacement of pivot point 104 toward the barbell support end to partially compensate for the associated downward displacement of the pivot point, thereby realizing the benefits of the present invention.

Returning to FIG. 1, weight bench 10 of this invention may also include a secondary support arm 106 extending between and connected to back frame 46 and the stem 18 of foot-end frame 14. In addition, the weight bench 10 will generally include a back cushion 108 and a seat cushion 110 attached to and supported by back frame 46 and seat frame 48, respectively. The cushions generally comprise a soft padding core element, such as foam or rubber, covered by a moisture-repellent material, such as vinyl. In a preferred embodiment, the back cushion 108 and the seat cushions 110 are connected in hinged or pivoted relationship such that a user's body would not directly contact any part of the bare frame elements In a preferred embodiment, the back cushion 108 includes a lumbar support 111 in the form of an inflatable bladder 112 as part of the core element together with means for inflating or deflating the bladder, such as with a hand-held air bulb 114 connected to bladder 112 with flexible tubing 116. By positioning the bladder 112 in the section of the back cushion 108 adjacent the seat cushion 110 and inflating it prior to use, the bladder provides added support and comfort to the lumbar area of the user.

The weight bench of this invention may also include a generally L-shaped leg lift frame 118 so that weight bench 10 can also be used for a variety of arm and leg exercises. For example, in the flat position, the bench with leg lift frame 118 can be used for concentrated arm curls or leg curls. In the sitting position, the weight bench with leg lift frame 118 can be used for leg lifts. Leg lift frame 118 is pivotally connected at approximately the center point of its L-shaped frame to a bracket 120 extending from the second end of seat frame 48.

A close-up view showing enlarged details of one attachment mechanism for the leg lift frame 118 is shown in FIG. 1A. A pivot bolt 122 adapted to mate with a leg lift bushing 124, washers 126 and lock nut 128, connects leg lift frame 118 to seat frame 48 using apertures in bracket 120.

Leg lift frame 118 also includes cross bars 130 with removable foam pads 132 at each end thereof extending from the frame near the two ends thereof and a weight support bar 134 with spring clips 136 to hold the weights in place. The center portions of cross bars 130 include nylon sleeves 138 designed to mate with one or more apertures in leg lift frame 118 so that the position of the cross bars can be readily adjusted. A stop 140 extends from the back end of leg lift frame 118.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. Apparatus for a weight-lifting bench comprising in combination:

(a) frame means including a head-end frame adapted to rest in part on a level surface; a barbell support frame extending upwardly from said head-end frame; a foot-end frame adapted to rest in part on a level surface; a back frame pivotally connected to said head-end frame; a seat frame pivotally connected at a first end thereof to said back frame and pivotally connected at a second end thereof to a first end of a support arm, a second end of said support arm being pivotally connected to said foot-end frame;

(b) fastening means on said support arm and on said back frame to releasably connect said back frame to said support arm adjacent said first end of said support arm or alternatively at at least one other location intermediate said first and second ends of said support arm; and (c) body support means comprising a back support connected to said back frame and a seat support connected to said seat frame.

2. The apparatus of claim 1 further wherein said back frame includes elongated slot means and said support arm includes an apertured fastening bar, said slot means designed to mate in sliding relationship with said apertured fastening bar; and a removable lock pin so dimensioned as to be capable of passing through both said apertures in the fastening bar and said slot means so as to lock said back frame in place relative to said support arm.

3. The apparatus of claim 2 further wherein said apertured fastening bar includes an aperture proximate to said first end of said support arm and at least one other aperture intermediate said first and second ends of said support arm.

4. The apparatus of claim 1 wherein said head-end frame includes a generally U-shaped tubular member adopted to rest on a level surface and two back frame supports extending upwardly from either side of the center point of said U-shaped member and spaced from one another a distance approximately equal to the width of said back frame and pivotally connected thereto at their upper ends.

5. The apparatus of claim 4 wherein said barbell support frame comprises two barbell supports, each extending upwardly from a point proximate to the extremities of said U-shaped member.

6. The apparatus of claim 5 further comprising a barbell support cross member extending between and connected to said barbell supports at approximately the same height above said U-shaped member as the height at which said back frame is pivotally connected to said back frame supports.

7. The apparatus of claim 6 further comprising back support cross members extending between and connected to said back frame supports and said barbell support cross member.

8. The apparatus of claim 4 further wherein said foot-end frame comprises a generally T-shaped tubular member, comprising a stem element and a cross element.

9. The apparatus of claim 8 wherein the free end of said stem element of the T-shaped member is connected to said U-shaped member at approximately the center point of said U-shaped member.

10. The apparatus of claim 9 further comprising a secondary support arm extending between and connected to said back frame and said stem element of said T-shaped member.

11. The apparatus of claim 1 further comprising a leg lift frame comprising a generally L-shaped tubular member pivotally connected to said second end of said seat frame.

12. The apparatus of claim 11 further comprising a plurality of apertures in said L-shaped member proximate to the extremities thereof and a plurality of cross bars configured to be removably positioned in said apertures.

13. The apparatus of claim 1 further comprising back cushion means attached to said back frame and seat cushion means attached to said seat frame.

14. The apparatus of claim 13 wherein said back cushion means and said seat cushion means are pivotally connected to one another.

15. The apparatus of claim 13 wherein said back cushion means comprises an inflatable bladder located inside said back cushion means and adjacent said seat cushion means.

16. In an improved adjustable weight-lifting bench apparatus comprising a base frame, a back frame, and a seat frame, one end of said back frame pivotally connected to a first end of said seat frame, wherein the improvement comprises first pivot means for pivotally connecting said back frame to said base frame, second pivot means for pivotally connecting said seat frame adjacent its free end to said base frame, a support arm pivotally connected at a first end thereof to a second end of said seat frame and pivotally connected at a second end thereof to said base frame, and fastening means for releasably connecting said back frame to said support arm adjacent said first end of said support arm or alternatively at at least one other location intermediate said first and second ends of said support arm.

17. The apparatus of claim 16 additionally comprising elongated slot means integral with said back frame and mating in sliding relationship with an apertured element integral with said support arm, and a removable lock pin that passes through both said elongated slot and the apertures in said apertured element thereby locking the back frame in place relative to the support arm.

18. An adjustable exercise bench comprising:

(a) a base frame;

(b) a support frame including back means and seat means;

(c) a support arm having first and second ends, said first end pivotally connected to said base frame, said second end pivotally connected to said support frame, said support arm being slidably connected to said support frame;

(d) first, second, third and fourth pivot means, said first pivot means connecting said back means to said base frame, said second pivot means connecting said back means to said seat means, said third pivot means connecting said seat means to said support arm, and said forth pivot means connecting said support arm to said base frame;

(e) said support frame constrained by said first, second, third and fourth pivot means for limited movement between a substantially flat position and an inclined position, an angle formed between said back means and said seat means when said support frame is in its inclined position, said first and fourth pivot means fixed against linear movement relative to said base frame as said support frame is moved between its flat position and its inclined position, said second and third pivot means constrained for linear movement relative to said base frame as said support frame is moved relative to said base frame as said support frame is moved between its flat position and its inclined position; and (f) fastening means releasably connecting said support arm and said back means and permitting movement of said support frame between said flat and inclined positions.

19. The adjustable exercise bench of claim 18 wherein said back means includes lumbar support means.

20. The adjustable exercise bench of claim 18 wherein said lumbar support means is an inflatable bladder disposed within said back means for providing support to the lumbar area of a user.

21. A weight-lifting bench comprising:

(a) a frame;

(b) support means operatively connected to said frame, said support means including a back member and a seat member, said back member pivotally connected to said seat member, said back member having an adjustable lumbar support;

(c) a support arm, one end of said support arm pivotally connected to said seat member, the other end of said support arm pivotally connected to said frame; and (d) fastening means releasably connecting said back member to said support arm adjacent said one end of said of said support arm or alternatively at least one other location intermediate said one end and said other end of said support arm.

22. The weight-lifting bench as claimed in claim 21 wherein said adjustable lumbar support includes an inflatable bladder that is disposed within said back means for providing support to the lumbar area of a user.

* * * * *